US011428506B2

(12) United States Patent
Azhagesan

(10) Patent No.: US 11,428,506 B2
(45) Date of Patent: Aug. 30, 2022

(54) COMPACT VEHICLE DOOR PROTECTOR AND BULLET-PROOF AUTO SHIELDS

(71) Applicant: Muthukumaran Azhagesan, Wayne, PA (US)

(72) Inventor: Muthukumaran Azhagesan, Wayne, PA (US)

( * ) Notice: Subject to any disclaimer, the term of this patent is extended or adjusted under 35 U.S.C. 154(b) by 0 days.

(21) Appl. No.: 16/578,330

(22) Filed: Sep. 21, 2019

(65) Prior Publication Data

US 2021/0088314 A1 Mar. 25, 2021

(51) Int. Cl.
*F41H 5/00* (2006.01)
*F41H 5/22* (2006.01)
*F41H 5/013* (2006.01)

(52) U.S. Cl.
CPC ..... *F41H 5/226* (2013.01); *F41H 5/013* (2013.01)

(58) Field of Classification Search
CPC . F41H 5/00; F41H 5/226; F41H 5/013; B60R 19/42
USPC ..... 293/126–128; 49/70, 460, 463, 502
See application file for complete search history.

(56) References Cited

U.S. PATENT DOCUMENTS 6,062,617 A * 5/2000 Marks ..... B60J 11/06 293/128
6,644,716 B1 * 11/2003 McNabb ..... B60J 11/00 296/136.1
8,702,136 B2 * 4/2014 Azhagesan ..... B60J 11/06 293/128
9,333,714 B2 * 5/2016 Tunis, III ..... F41H 5/0471
2003/0146630 A1 * 8/2003 Ko ..... B60J 11/06 293/128
2007/0278804 A1 * 12/2007 Shields ..... B60J 11/025 293/128
2008/0258482 A1 * 10/2008 Udolph ..... B60R 19/42 293/128

OTHER PUBLICATIONS

Bertolini; Alberto (Este, IT), Publication No. WO/2016/026554 International Application No. PCT/EP2015/001630, Bullet- and Blast-Resistant Window and Associated Apparatus.
Kapiloff, et al., U.S. Pat. No. 9,657,513B1, Shatter-resistant, optically-transparent panels and methods of use of the panels for on-site retrofitting and reinforcing of passageways.
Engl; Andreas (Munchen, DE) Assignee: Isoclima S.P.A. (Este, IT), U.S. Pat. No. 9,273,934 Bullet-proof glass pane and associated bullet-resistant apparatus.
Azhagesan, Muthukumaran, U.S. Pat. No. 8,702,136, Vehicle Door Protector.

* cited by examiner

*Primary Examiner* — William V Gilbert

(57) ABSTRACT

A compact vehicle door protector and Bullet-proof Auto Shield that protects any type of vehicle such as but not limited to a car, truck, sports utility vehicle, van, aircraft, which is easy and quick to install, and removable from vehicle, folded and stored away compactly before and after use, and more importantly serves as an auto door shield, capable of protecting the driver and occupants of the vehicle from harmful bullets or projectiles, while the extant vehicle is stationary or in motion.

1 Claim, 7 Drawing Sheets

COMPACT VEHICLE DOOR PROTECTOR AND BULLET-PROOF AUTO SHIELDS

CROSS-REFERENCES TO RELATED APPLICATIONS

Continuation in part of "Vehicle Door Protector" [U.S. Pat. No. 8,702,136,B2], Muthukumaran Azhagesan

FEDERALLY SPONSORED RESEARCH OR DEVELOPMENT

Not Applicable

INCORPORATED BY REFERENCE OF MATERIAL SUBMITTED ON A COMPACT DISK

Not Applicable

SPECIFICATION

To All Whom It May Concern

Be it known that, I, Muthukumaran Azhagesan, an United States legal resident since the year 2000, and an Indian Citizen, have invented a Compact Vehicle Door Protector and Bullet-proof Auto Shield, [that has improved features from my earlier invention "Vehicle Door Protector" [U.S. Pat. No. 8,702,136,B2], as described in this specification. A portion of the disclosure of this patent document contains material which is subject to copyright protection.

BACKGROUND OF THE INVENTION

Various types of Vehicle door protectors and/or bullet-proof auto door protectors are known in the prior art including and especially my earlier invention "Vehicle Door Protector" U.S. Pat. No 8,702,136,B2. However, to solve the common and undeniable issue of vehicles of any size or any scale (including but not limited to cars, trucks, aircrafts, or similar automobiles) getting dents, dings, scratches, and/or any kind of blemishes and more importantly serve dual purpose, also as an auto door shield protecting the driver and passengers of the vehicle, is an efficient, low to zero maintenance, at the same time, a compact and scratch proof (so that it doesn't introduce any blemishes to the vehicle where it comes in contact with, is attached to and detached from) vehicle door protector, is needed in order to act as a shield to the vehicle doors, from adjacently parked vehicles, and vehicles approaching to be parked, and easy for storage and retrieval.

This compact vehicle door protector, when it is installed, and while the vehicle is in motion or stationary, thus is capable of serving an important purpose in the current world, which is to shield and save precious lives of the vehicle driver and passengers inside the vehicle from harmful bullets, which could be particularly useful for any police official, or military personnel, whose lives deal with dangers, while they are in duty.

FIELD OF THE INVENTION

The present invention relates to a compact Vehicle Door protector and Bullet-proof Auto Shield, that includes a light weight shell member, configured to overlie and superimpose upon a vehicle door, said shell member having a single or double exterior surface and a pliable, scratch proof interior surface (scratch proof to itself from external objects and/or components, and the object-vehicle exterior it comes in contact with), and said shell member can be singular or plurality, which are held together by a set of hinges, thereby facilitating a seamless movement of the shell members, mainly to make the present invention to be foldable and facilitating it to be stored away compactly, when not in use and/or when after use.

The plurality of shell members are releasably secure to the extant vehicle door by means of a singularity or plurality of securing and adjustable straps, whereby the finish and the paintwork of the vehicle to which the device is attached is protected from dents, dings, scratches, and/or other blemishes rendered thereto by the opening of doors of adjacently parked vehicles.

In addition to preventing vehicle door protectors as described above, the present invention also can function as a Bullet-proof Auto Shield. As a dual purpose, the present compact vehicle door protector, when it is installed to the vehicle, and while the vehicle is in motion or stationary, can shield the vehicle driver and passengers inside the vehicle from harmful bullets and/or projectiles, which could be particularly very useful in protecting the occupants including but not limited to police officials, or military personnel, while they are in duty and whose lives may deal with dangers.

SUMMARY OF THE INVENTION

The general purpose of the compact vehicle door protector, described in subsequent detail is to provide a shield to vehicle doors which has all the features mentioned in one of my earlier inventions named Vehicle Door Protector, U.S. Pat. No. 8,702,136,B2, and additionally has many features described in detail in the prior and upcoming relevant sections in this specification.

The present invention is featured to be folded away and stored in trunk of the car or a truck in a compact manner, thereby occupying less storage space, while the product is not in use. This fold away is feasible by using a singularity or plurality of hinges that connect the plurality of shell members. As a dual purpose, the present compact vehicle door protector, when it is installed in the vehicle, and while the vehicle is in motion or stationary, also is capable of serving another important purpose in the current world, which is to shield the vehicle driver and passengers inside the vehicle from harmful bullets and/or projectiles, which could be particularly very useful in protecting the occupants including but not limited to police officials, or military personnel, while they are in duty and whose lives may deal with dangers.

The present invention includes a singularity of shell member with no hinges, or plurality of shell members which are connected and coordinated by a singularity or plurality of hinges. The hinges are either made of metal, alloy, plastic, or any other sturdy/strong material suitable for the shell member(s).

These hinges play an important role in enabling the plurality of shell members to be folded away, when the present invention is not in use, thereby making the product storable in a smaller storage space, be it inside the vehicle's trunk or in a home's car garage, or anywhere the compact door protector is desired to be stored. Here it should be noted that due to the compact quality of the present invention mentioned above (as Auto stores, and the warehouses of online Shops[websites] will need only lesser storage space to store the present compact vehicle door protector inventory), the marketability will be easy and demand to procure the present invention based product from manufacturer(s), then to distribute and/or sell it to interested parties (distributors, vehicle owners) will be high, thereby resulting in a quick turnaround in terms of ROI (return of investment) to the investor (manufacturer) and sellers.

Importantly, the hinges as explained above, that combine and connect the plurality of shell members are affixed to the shell members in such a way that the hinges don't touch or scratch the finish or paintwork of the vehicle exterior.

As elaborated in the top second paragraph of this section above, in this specification, the present compact vehicle door protector is another version of my "Vehicle Door Protector" U.S. Pat. No. 8,702,136,B2 with new additional advantages focused on compact storage of the product, and making the vehicle doors bullet-proof, thereby protecting the occupants of the vehicle.

The scope of the invention is directed to covering the exterior of a vehicle door (that is vulnerable to dents, dings, scratches and/or blemishes), using the compact vehicle door protector consisting of a singular or plurality of shell members superimposed by a singular or plurality of securing and adjustable straps. Thus has been broadly outlined the more important features of the compact vehicle door protector so that the detailed description thereof that follows, may be better understood and in order that the present contribution to the art may be better appreciated.

Objects of the present Compact Vehicle Door Protector, along with various novel features that characterize the invention are particularly pointed out in the claims forming a part of this disclosure. For better understanding of the present invention, its operating advantages and specific objects attained by its uses refer to the accompanying drawings and description.

BRIEF DESCRIPTION OF THE DRAWINGS

With Corrected Drawing Numbers & Descriptions (FIGS. 6 To 7) Figures

DETAILED DESCRIPTION OF THE DRAWINGS

Figure 1:
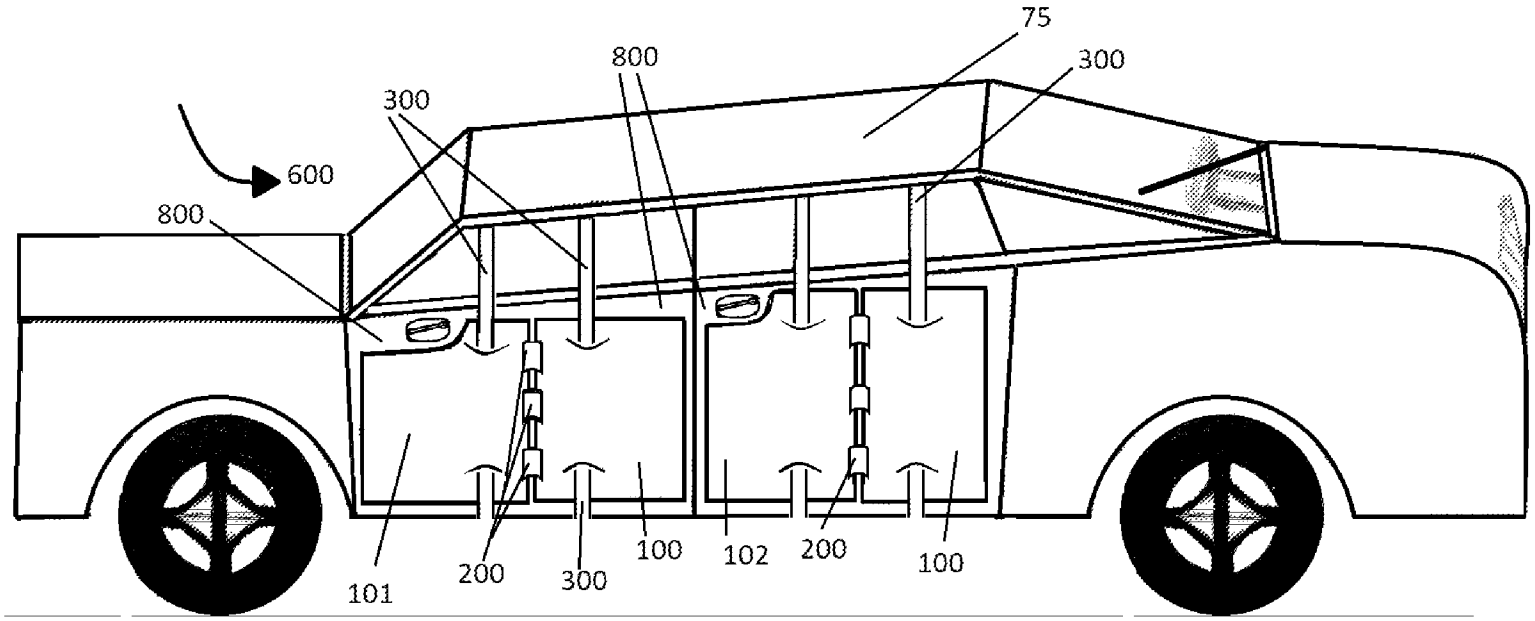
FIG. 1 is an in-use view of present invention (i.e. Compact Vehicle Door Protector)
Figure 2:
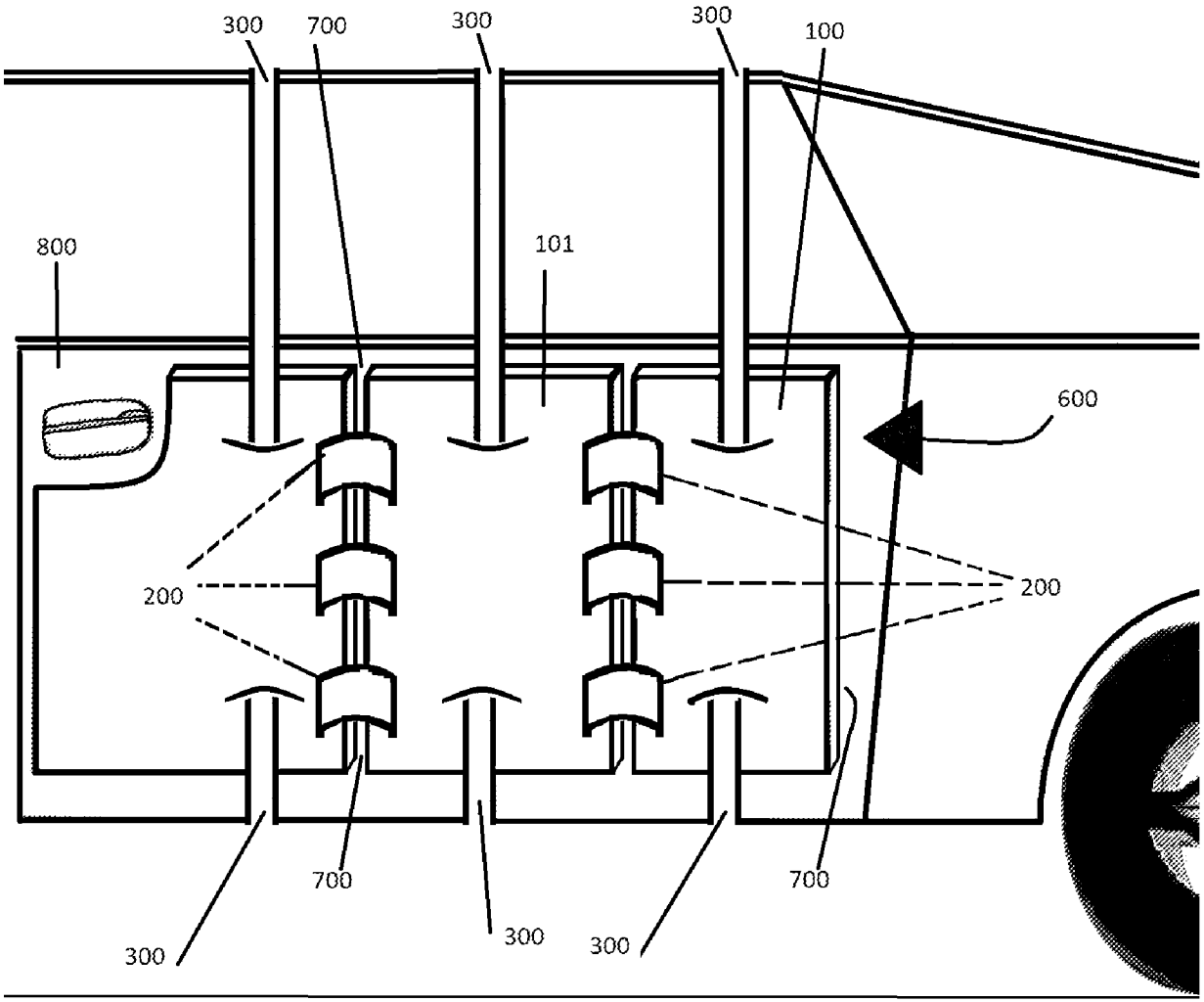
FIG. 2 is a view of exterior surface of present invention
Figure 3:
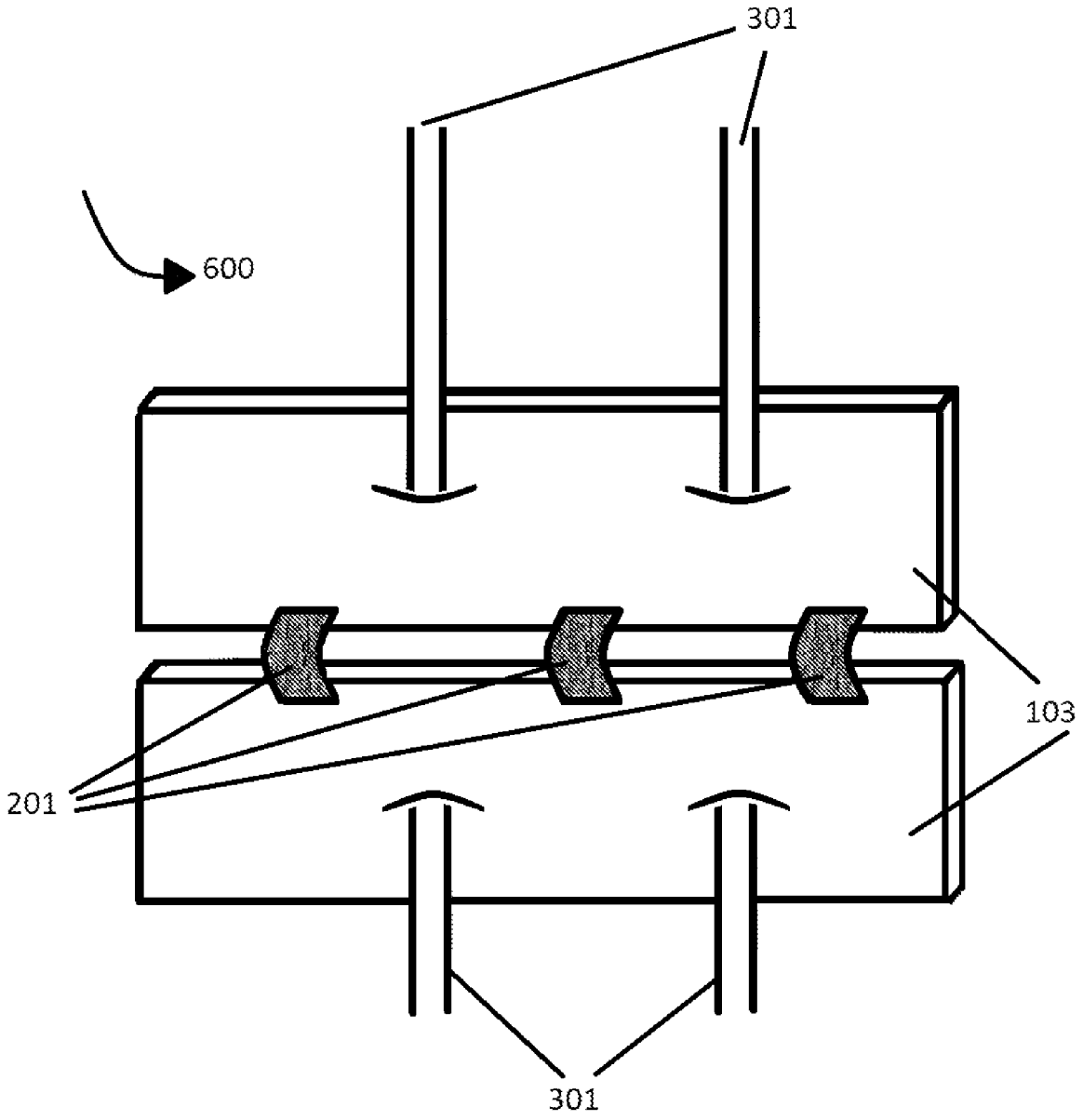
FIG. 3 is a view of exterior surface of a variant of Compact Vehicle Door Protector
Figure 5:
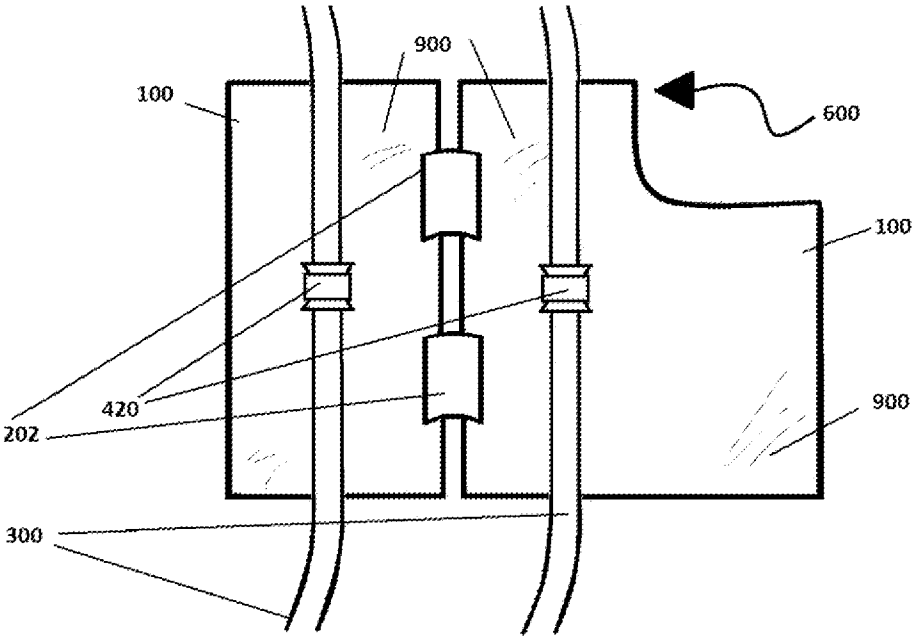
FIG. 5 is a view of interior surface of present invention
Figure 4:
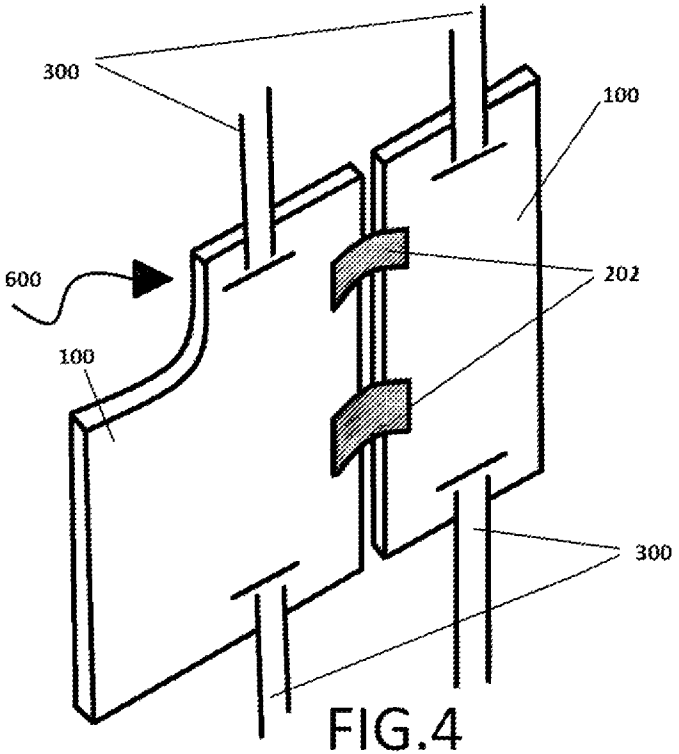
FIG. 4 is an isometric view of present invention
Figure 6:
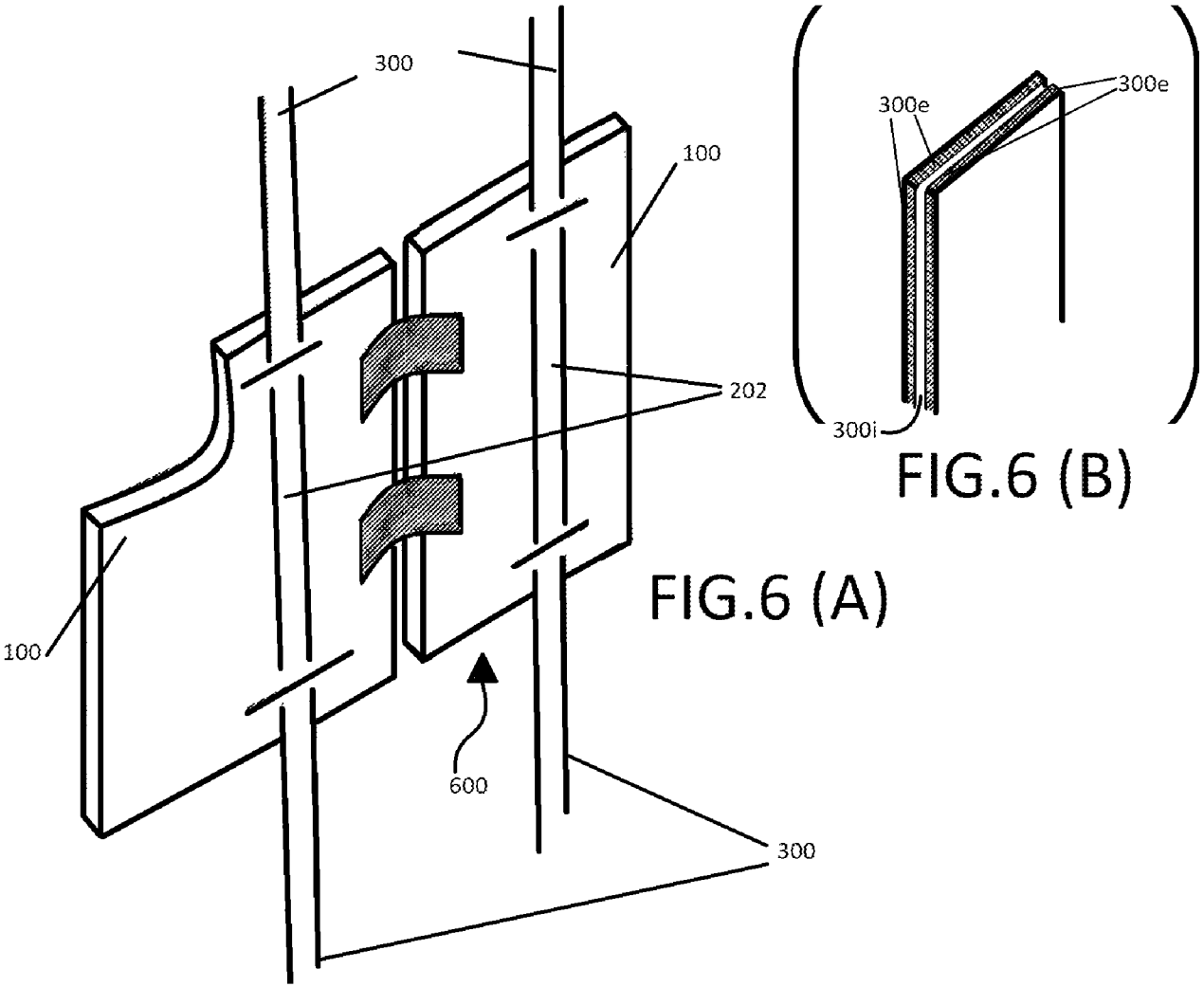
FIG. 6(A) is a view of exterior surface of another variant of Compact Vehicle Door Protector
FIG. 6(B) is a zoomed in cross-section view of a securing strap of Compact Vehicle Door Protector
Figure 7:
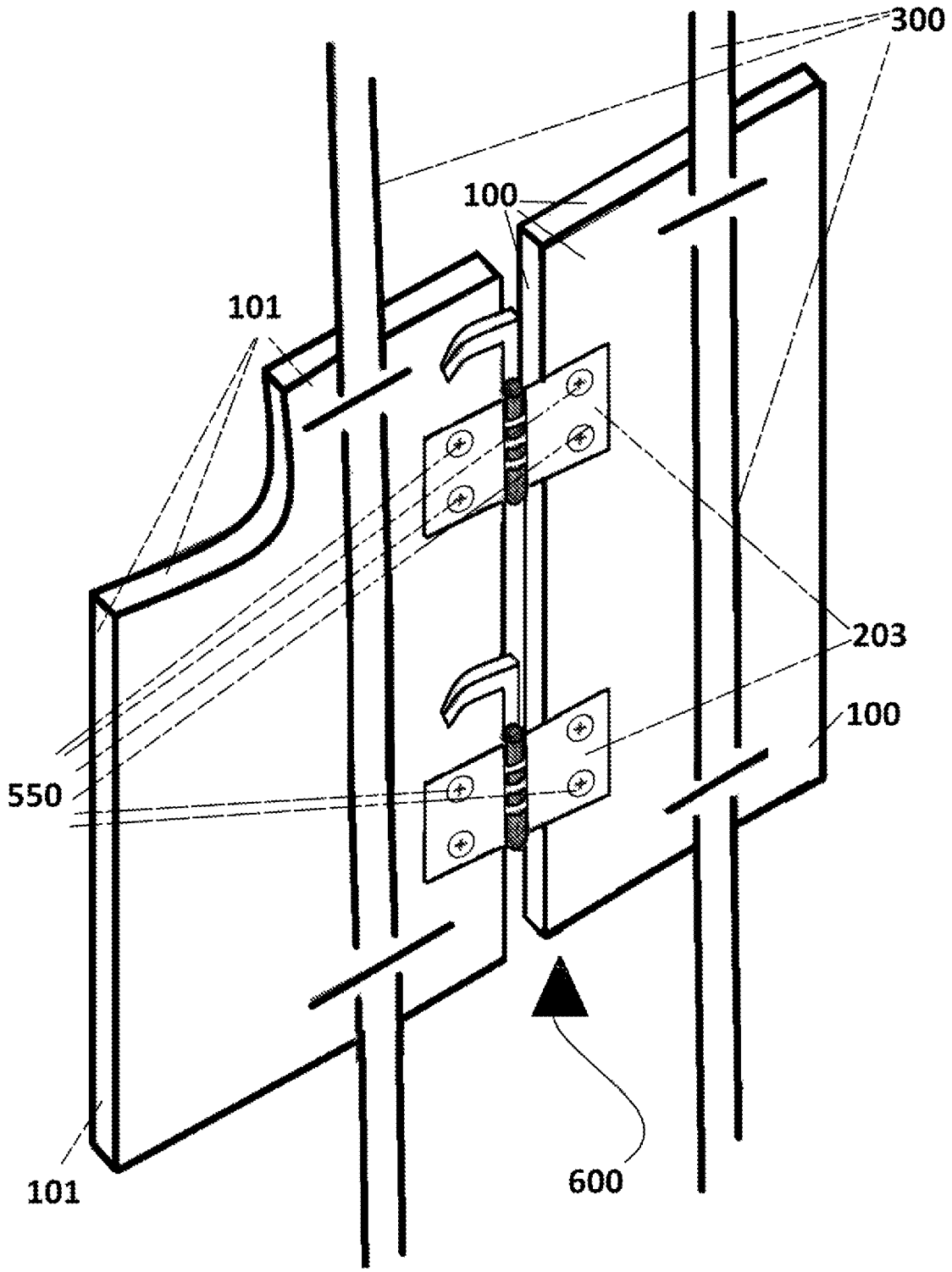
FIG. 7(A) is a view of exterior surface of another variant of Compact Vehicle Door Protector
FIG. 7(B) is a view of Compact Vehicle Door Protector's one of the installed hinges unfolded (while protector is in use) state and its lever in a locked state
FIG. 7(C) is a view of Compact Vehicle Door Protector's one of the installed hinges in a freely movable state as its lever in an unlocked state (needed when protector is about to be folded after use, or about to be unfolded before use)
FIG. 7(D) is a view of Compact Vehicle Door Protector's one of the installed hinges in folded state and its lever in a locked state
Figure 7:
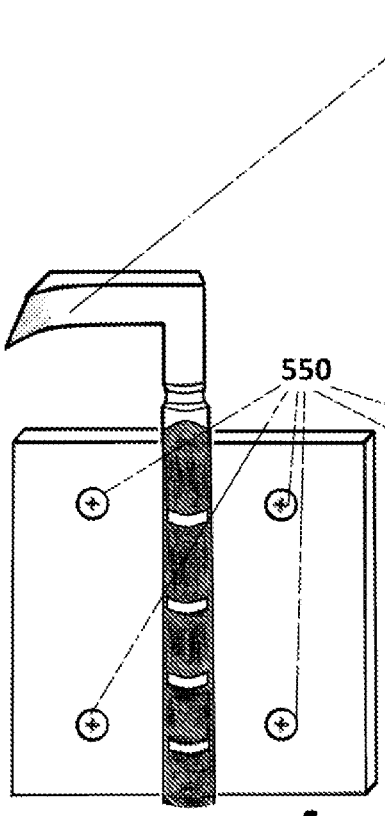
Figure 7:
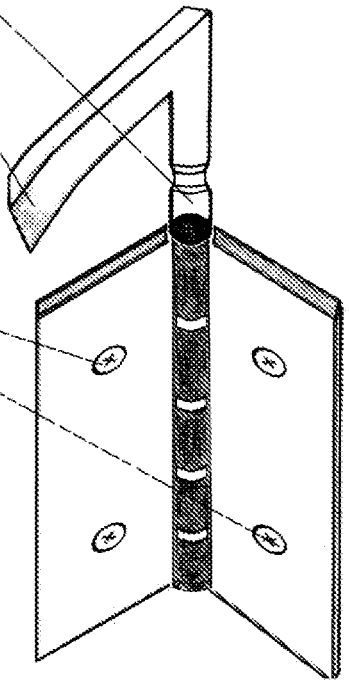
Figure 7:
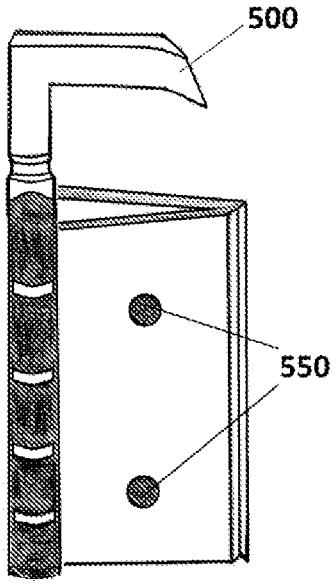

With reference now to the drawings, and in particular FIGS. 1 through 7 thereof, example of the compact vehicle door protector, based on my earlier invention named "Vehicle Door Protector" U.S. Pat. No. 8,702,136,B2, employing the principles and concepts of present compact vehicle door protector and generally designated by the reference number 600 will be described.

Referring to FIGS. 1 through 7, a preferred embodiment of the present compact vehicle door protector 600 is illustrated.

As described in the summary section above, the present invention Compact Vehicle door Protector 600, has most of the features as elaborated in my earlier invention named "Vehicle Door Protector" U.S. Pat. No. 8,702,136,B2, and in addition and/or in difference, has been designed to provide more benefits to the product users. The benefits, features, and purposes are described in detailed below, and in other sections above, with further granular detail.

The present compact vehicle door protector consists of a singular or a plurality of foldable shell members 100, 101, 102, 103 co-ordinated and connected by hinges 200, 201, 202 and 203.

The hinges are made of a strong metal, alloy, hardened plastic, or a combination thereof, or made of any suitable sturdy raw material. The hinges thus illustrated in FIGS. 1 through 7 200, 201, 202, and 203 seamlessly enable unfolding and folding of the shell members 100, 102, 103 before and after use respectively. These hinges 200, 201, 202, and 203 are also the sole parts responsible for providing the compact feature to the present compact vehicle door protector 600.

For a sturdier, rigid look & feel, more control, and an additional firmness to the present compact vehicle door protector 600, thereby shielding the extant vehicle door 800 from blemishes, dents, dings, or any scratches, a singularity or plurality of hinges 200, 201, 202, and 203 each may be equipped with a lockable lever facility 500, and so when 100, 101, and 102 or a combination thereof are unfolded, and after the straps 300 are securely fit and attached, next the user of present invention will switch on the hinge's(203) lever's (lock) 500, thereby enabling the added firmness with a "one shell member sturdiness", look and feel. Likewise, the user will (need to) remember to (a) unlock the lever 500 and (b) loosen/release the singularity or plurality of securable and adjustable straps 300 utilizing hasps 420 (accessible from the vehicle's interior), before folding the present compact vehicle door protector 600 for storing it away. If the vehicle user/owner/driver doesn't care or doesn't worry about the compacting (/folding) the present compact door protector 600, she/he can simply release/loosen the hasp(s) 420 attached to singularity or plurality of the adjustable/securing straps 300 and then store it away, whereby the shell members FIGS. 7(A) 100, 101 will not be foldable.

A singularity or plurality of the hinges elaborated above can also employ hinges 200, 201, and 202 which are of plug-and-play type without any need for screws and bolts.

Alternately the present compact vehicle door protector can have a singularity or plurality of hinges 203, embedded to the plurality of shell members 100 and 101 which require a set of screws or rivets 550 or a similar means of permanent fixture. These fixtures illustrated in detail in FIGS. 7(B), 7(C) and 7(D) are permanently installed to the plurality of shell members FIGS. 7(A) 100 and 101. The singularity or plurality of hinges FIGS. 7(A) 203 are installed in such a way that, they don't scratch or damage the extant vehicle's exterior 700, in anyway. Additionally for a uniform/plain look and feel for the compact vehicle door protector 600, each of the screws/rivets 550 can be glued or snapped in with durable studs made of plastic, metal, or any material compatible with the hinges 203 and screws/rivets 550, to provide a beautiful, wholesome look and feel to the present compact vehicle door protector 600.

Each of the plurality of shell members 100, 101 are made of materials, as described in my earlier invention named "Vehicle Door Protector" U.S. Pat. No. 8,702,136,B2. Additionally, the interior surface 900 are layered with or coated with a scratch proof material or substance, thereby eliminating the minimal probability of scratches that could be caused by the present compact vehicle door protector, while the present invention 600, comes in contact with the extant vehicle exterior 700.

To releasably secure each of the compact vehicle door protectors 600 to the desired extant vehicle doors 800, a plurality of securing straps are employed, as elaborated in my earlier invention named "Vehicle Door Protector" U.S. Pat. No. 8,702,136,B2. Alternately, the present compact vehicle door protector 600 can also be a singular whole shell member 100 without the need for any hinges 200, 201, 202, or 203 with a singular securing adjustable strap 300, or a plurality of shell members 100 and 101 with a singular or plurality of hinges 200, 201, 202, or 203 with a singular or plurality of securing adjustable straps 300.

The plurality of shell members 100, 101 which are one of the main components of the present compact vehicle door protector 600, can be connected/held together by the hinges 200, 201, 202, 203 either horizontally or vertically.

The present compact vehicle door protector's (600) shell member 100 can be made of metal as detailed in one of my prior inventions named "Vehicle Door Protector" U.S. Pat. No. 8,702,136,B2. The present invention's singularity or plurality of shell members 100, 101 can be installed to the extant vehicle door 800 using a singularity of plurality of securing straps 300 as detailed in the paragraph immediately above. The securing straps 300 of the present compact vehicle door protector 600 can also be made of a malleable, thin at the same time strong metal, for superior strength, to balance and seamlessly hold the weight of shell member, mainly and especially if the singularity or plurality of shell members 100, 101 are metallic. These securing straps 300 can also be of a custom made type, which can be coated with a thin layer of foam, plastic, rubber, or made of a mixture of these aforementioned elements, or made of any suitable substance to provide an easy to handle, customer friendly, durable, soft, and water-proof exterior layer **300*e* for a metallic interior 300*i*. The shell members 100, 101 thus installed to cover the exterior 700 of the extant vehicle door 800**, as detailed in the paragraph immediately above, can serve as a bullet-proof shield for the vehicle driver and passengers, safely protecting them from harm. Hence, in the current world, this present compact vehicle door protector can be an indispensable protector for any police official and military personnel, whose lives deal with dangers sometimes, while they are on duty, thereby securing the personnel, and ensure a safer world.

What is claimed is:

1. A vehicle door protector, comprising:

a shell member configured to cover a portion of an automobile door, said shell member having a first panel, a second panel and a third panel, said second panel being between said first panel and said third panel, said first panel being connected to said second panel by a first plurality of hinges and said second panel being connected to said third panel by a second plurality of hinges, each said panel having an interior surface configured to face said automobile door and an exterior surface opposite said interior surface, each said hinge having a locking lever configured to lock said respective hinge;

each said panel having a strap configured to attach said shell member to said automobile door, each said strap being made of a malleable metal, each said strap extending across respective said exterior surface of each said panel, each said strap having a hasp, each said hasp configured to permit adjustment of said respective strap, each said strap having a thin foam coating;

whereby when installed, said straps secure said shell member to said automobile door by wrapping around an upper and a lower edge of said automobile door.

* * * * *